United States Patent [19]

Akers

[11] 4,223,795

[45] Sep. 23, 1980

[54] CHILD-RESISTANT PACKAGE

[76] Inventor: Edward G. Akers, 647 Briarfield, Pecan Plantation, Granbury, Tex. 76048

[21] Appl. No.: 28,389

[22] Filed: Apr. 9, 1979

[51] Int. Cl.[2] ..... B65D 55/02

[52] U.S. Cl. ..... 215/222; 215/223; 150/0.5; 206/535

[58] Field of Search ..... 206/535; 215/222-223, 215/DIG. 4; 220/293, 295, 301-302; 150/0.5

[56] References Cited

U.S. PATENT DOCUMENTS

| | | | |
|---|---|---|---|
| 2,852,054 | 9/1958 | Motley | 150/0.5 |
| 3,917,096 | 11/1975 | Hedgewick | 215/222 X |
| 3,951,289 | 4/1976 | Lawden | 215/222 X |

FOREIGN PATENT DOCUMENTS

| | | | |
|---|---|---|---|
| 760802 | 6/1967 | Canada | 215/223 |

*Primary Examiner*—Davis T. Moorhead
*Attorney, Agent, or Firm*—Peter J. Murphy

[57] ABSTRACT

A two piece combination of a container and cap, wherein the neck portion of the container and the flange of the cap have interengaging locking elements for securing the pieces together. A generally cylindrical flexible wall is an extension of the container neck, and terminates in annular free end perpendicular to the container neck. This annular free end engages an internally beveled surface of the cap, such that when the locking elements are engaged, the annular free end is deflected radially inwardly to provide an axially biasing force maintaining the elements engaged and also providing a seal between that member and the cap beveled surface.

16 Claims, 6 Drawing Figures

CHILD-RESISTANT PACKAGE

BACKGROUND AND SUMMARY OF THE INVENTION

This invention relates to a safety package consisting of a container and cap wherein the parts are designed to inhibit the opening of the package by children; and more particularly to such safety package for containing hazardous substances either in tablet, particulate, or liquid form.

This invention is concerned with safety packages of the type which are described in applicant's prior U.S. Pat. Nos. 3,880,313 and 3,880,314 issued Apr. 29, 1975. Safety packaging of the type with which this invention is concerned, is sometimes referred to as "child-resistant packaging"; and the purpose of such packaging is to provide suitable containers for hazardous substances such as dangerous drugs, insecticides, cleansing compound, poisons or other substances which will be particularly hazardous to children if stored in containers which are readily opened by children.

A principal object of this invention is to provide an improved safety package of simple design, enabling the economic manufacturing and marketing of such package.

A further object of this invention is to provide such a safety package consisting of only two parts which are suitable for fabrication by injection molding techniques.

Still another object of this invention is to provide a safety package which is particularly suitable as a package of very small size for enclosing a stack of pharmaceutical tablets for example, and which has a clean-cut and aesthetically pleasing appearance.

A still further object of this invention is to provide such a safety package which is completely sealed to prevent loss of the enclosed material and to prevent the entry of contaminants into the package.

Another object of this invention is to provide such a safety package which is suitable for containing particulate and liquid materials as well as materials in tablet or other solid form.

A further object of this invention is to provide a safety package, particularly adapted for use as a small package, wherein the amount of material required for fabricating the container and cap is minimized for producing a package having a desired internal volume.

Still another object of this invention is to provide a safety package adapted to be sealed against the entry of contaminants; and wherein the outer diameter of the container neck and the cap may be reduced, in relation to the designs of applicant's eariler patents, while maintaining the same diameter at the container neck.

These objects are accomplished in a fluid tight safety container and cap combination which comprises a container having a neck portion comprising a generally cylindrical annular wall, and a cap having a base with a peripheral skirt projecting axially therefrom for receiving the neck. Interengageable locking elements are provided on the outer wall of the container neck and on the inner wall of the cap skirt, with both the container locking elements and the cap locking elements being spaced peripherally from each other. The cap locking elements are engageable with and disengageable from the container locking elements through combined axial and rotative motion of the cap relative to the container. An annular, flexible member is formed on the distal end of the neck, as an extension thereof, and has an outer annular free end disposed in a plane perpendicular to the neck and the flexible member. The cap has an internal annular sloping surface disposed between its base and its locking elements, which sloping surface is engageable with the free end of the flexible member to exert an axial biasing force between the cap and container when the locking elements are engaged.

More particularly, the annular free end of the flexible member is compressed radially inward by the sloping surface to provide both the axial biasing force and also a seal between the container and the cap.

The novel features and the advantages of the invention, as well as additional objects thereof, will be understood more fully from the following description when read in connection with the accompanying drawing.

DRAWING

DESCRIPTION OF THE PREFERRED EMBODIMENT

Figure 1:
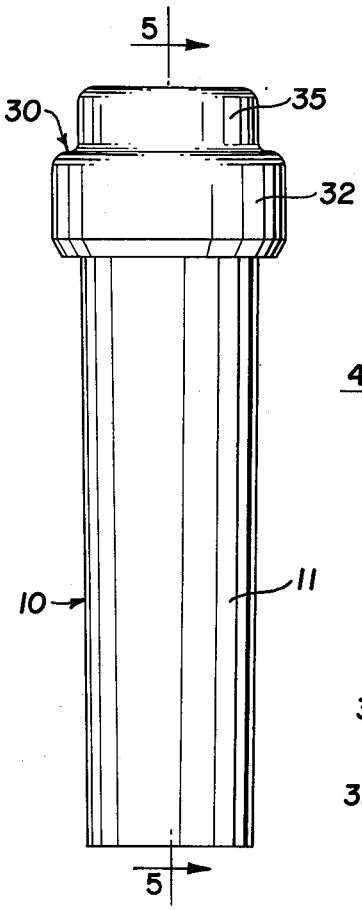
FIG. 1 is an elevation view of a safety package according to the invention.
Figure 2:
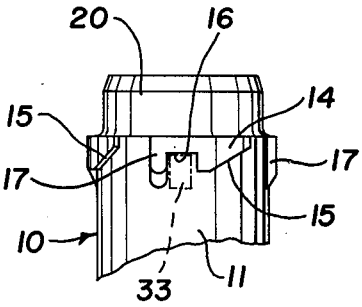
FIG. 2 is a fragmentary elevation view of the neck portion of the container illustrated in FIG. 1.
Figure 3:
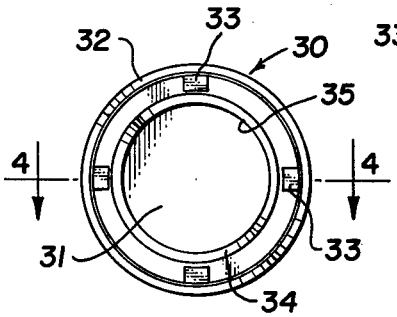
FIG. 3 is a bottom view of the cap illustrated in FIG. 1.
Figure 4:
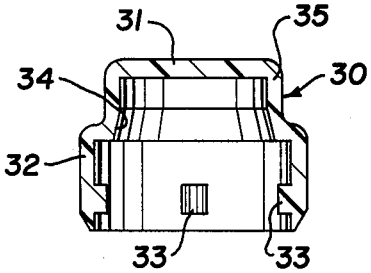
FIG. 4 is an axial sectional view of the cap taken along the line 4—4 of FIG. 3.

Referring to FIGS. 1 through 5 of the drawings, the safety package illustrated includes a container having a generally cylindrical body with a generally uniform internal diameter which extends through the mouth; and which package is particularly adapted for containing a single stack of round tablets for example. In this configuration, the container neck, or neck portion, is not particularly distinguishable from the body portion, except as providing the mount or support for locking elements engageable with the cap. In the following specificiation the references to neck or neck portion refer to the portion of the container adjacent to its mouth; and it is to be understood that this invention is concerned with containers of any size or configuration which may or may not have a distinguishable neck portion.

The safety package illustrated in FIGS. 1 through 5 consists of a one piece container 10 and a one piece cap 30, both of which are formed preferably from suitable plastic materials adapted for fabrication by injection molding.

The container 10 includes a generally cylindrical body 11 having a closed bottom or end 12, with the body walls being very slightly tapered to facilitate removal from the mold. The container includes a neck 13, which is the portion adjacent to the container mouth, having sufficient wall thickness or body to support locking elements which coact with corresponding locking elements on the cap, to be described.

The locking elements consist of four radially projecting lugs 14, which are equally spaced around the outer periphery of the neck. Each of the lugs includes an inclined camming ramp 15 facing away from the container mouth and in a counterclockwise direction as viewed from the container mouth, a clockwise adjacent recess 16 opening away from the container mouth, and a stop 17 at the side of the recess opposite from the camming ramp.

The container also includes an annular flexible member 20 which extends axially from the distal edge of the container neck, and is in the form of a generally cylindrical relatively thin wall. This flexible member terminates in an annular free end disposed in a plane perpendicular to the longitudinal axis of the container; and is flexible, at least in the area adjacent to its annular free end, for a purpose to be described. In the illustrated container, the inner wall of the flexible member 20 is a continuation of the generally cylindrical inner wall of the container body and neck.

The cap 30 is a cup-shaped member consisting of a planar top or base wall 31, and an axially projecting cylindrical skirt 32 which defines the side walls of the cap. The inner wall of the skirt is dimensioned to provide an annular clearance between the skirt and the outer cylindrical wall of the container neck 13. Four locking elements are in the form of radially inward projecting lugs 33, rectangular in shape and equally spaced about the periphery of the cap. These lugs are configured and dimensioned for coaction with the lugs 14 of the container; and are particularly dimensioned to be received within respective recesses 16 as will be described.

These lugs 33 are disposed adjacent to the distal edge of the skirt 32; and the cap is provided with an internal sloping surface 34 which is spaced inwardly from the lugs 33. This sloping surface is a frusto-conical surface having a central axis coincident with the central axis of the cap, and which reduces in diameter toward the base 31. The respective diameters of the frusto-conical surface 34 and the free end of the flexible member 20 are such that the free end will engage the frustoconical surface when the parts are moved together. The relative axial spacing between the frusto-conical surface 34 and the associated cap lugs 33, and between the free end of the flexible member 20 and the associated container lugs 14, are such that the frusto-conical surface will be engaged with the flexible member when the inner edges of the cap lugs are positioned to engage the portions of the camming ramps 15 nearest to the container mouth.

It will be seen that with relative clockwise rotation of the cap and container, the cap lugs 33 will move downwardly on the respective ramps 15, with corresponding downward movement of the tapered surface 34 which necessarily compresses the free end of the flexible member radially inward. The resistance to compression of this flexible member creates an axial biasing force resisting this downward movement of the cap; and when the cap lugs 33 move into alignment with the container lug recesses 16, this biasing force urges the cap lugs into the locking relation illustrated by the phantom line position of the lug 33 in FIG. 2. The stops 17 prevent over-rotation of the cap lugs 33 relative to the recesses 16. Manual axial compression of the cap and container will assist in overcoming the biasing force. It will be seen, then, that a combination of axially compressive and clockwise rotational force is effective to engage and lock the cap 30 to the container 10. By the same token, a combination of axially compressive movement and counterclockwise rotation will release the cap lugs 33 from the recesses 16; and the stops 17 will prevent excessive counterclockwise rotation of the cap and permit axial removal of the cap from the container.

The above mentioned radially inward deflection or compression of the annular free end of the flexible member 20 produces an axial biasing force which is, of course, sufficient to maintain the locking element engaged; and, further, it must be of sufficient magnitude to inhibit a child from effecting the release of the cap from the container. This same biasing force maintains the flexible member in sealing relation with the frusto-conical surface 34 to prevent the leakage of the enclosed material from the package, and also to prevent the entry of exterior contaminant materials into the package. This seal can be made sufficiently tight so that the package is effective as a package for liquid materials, and also so that when the package is used for enclosing moisture absorbing materials, the seal will prevent the ingress of moisture or humitidy from the exterior of the package.

Figure 6:
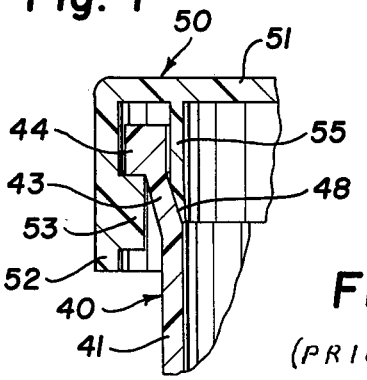
Fig. 6 (PRIOR ART)
FIG. 6 is a fragmentary view of a prior art container cap assembly for comparison with FIG. 5.

FIG. 6 is a fragmentary view illustrating comparative structure and operation of a prior art safety package of the type described in applicant's prior U.S. Pat. No. 3,880,313. This safety package consists, also, of a one piece container and a one piece cap. A container 40 includes a body 41, a neck 42 and locking lugs 44 on the neck which may have the same configuration as the lugs 14. The body 41 is otherwise identical to the body 11. This container is provided with an internal tapered or frusto-conical surface 48 which is adjacent to the lip of the container mouth. A coacting cap 50 is, again, a cup-shaped member having a top or base wall 51 and an axially projecting skirt 52 defining the side walls of the cap. Locking lugs 53 are provided on the inner wall of the skirt; and they may have the same configuration and function in the same manner as the above described lugs 33. In this configuration the cap is provided with an annular flexible member in the form of a generally cylindrical, relatively thin wall 55 which is fixed at its inner end to the base 51, and which has an outer annular free end disposed in a plane perpendicular to the cap axis. This flexible member 55 is, again, flexible at least adjacent to its outer free end, and is dimensioned relative to the container tapered surface 48 to engage that tapered surface and be deflected radially inwardly when the parts are assembled. In this assembly the the locking lugs of the inner end cap coact in the manner previously described with the cap flexible member engaging the container tapered surface to provide the axial biasing force to interlock the lugs and provide the desired seal.

Referring to FIG. 6, it will again be seen that the inner surface of the container body and the inner surface of the cap flexible member 55 define a cylindrical inner wall of continuous and uniform cross-section. In order to achieve this, the neck 43 must be flared outwardly to provide sufficient internal diameter to accommodate the tapered surface 48, assuming that the body thickness of the container 40 corresponds to the body thickness of the container 10. Since the ncek for the container 40 must be of greater diameter than that for the corresponding container 10 according to the invention, the diameter of the cap 50 must also be correspondingly greater. This produces a relatively large radial overhang of the cap skirt 52 relative to the container body 40 which produces an awkward or aesthetically displeasing appearance of the assembled safety package.

Figure 5:
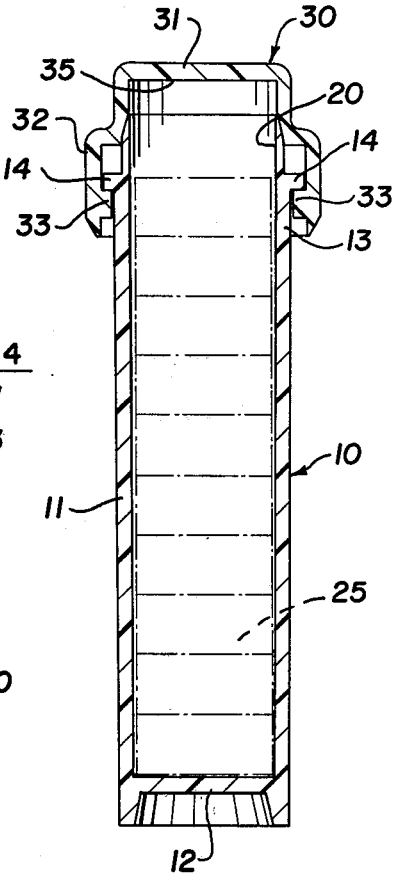
FIG. 5 is an axial sectional view of the package taken along the line 5—5 of FIG. 1.

In the illustrated FIG. 5 package, the cap 30 is provided with a relatively deep space or dome 35 between the base 31 and the sloping surface 34; and this dome may be configured to provide an inner wall having a diameter generally the same as the inner diameter of the container at the mouth, and an outer diameter generally the same as that of the container for aesthetic reasons. Another function of this dome is that it may provide space for inserting a ball of cotton or similar material to protect the contained tablets; when the tablets are stacked to a point immediately adjacent to the top or free end of the flexible member 20. This dome could be much shallower, providing only sufficient space to accommodate the free end of the flexible member during the engagement and disengagement of the locking lugs. Comparing this configuration to the configuration of FIG. 6, it will be seen that where tablets are stacked to the top of the container 10, immediately adjacent to the free end of the flexible member in the FIG. 5 configuration, and immediately adjacent to the inner edge of the tapered surface 48 in the FIG. 6 configuration, the overall length of the container for the FIG. 5 configuration may be less than that for the FIG. 5 configuration, with a corresponding reduced overall length of the assembled package. Hence less material may be required for the fabrication of the container-cap package of FIG. 5 which has the same internal capacity as the container-cap package of FIG. 6.

What has been described is a novel form of child resistant package for containing hazardous substances whether solid, particulate or liquid.

A feature of this invention, in relation to prior art packages, is that for containers having the same inner diameter at the mouth, the outer diameter of the container neck may be reduced and the outer diameter of the coacting cap may be correspondingly reduced. For relatively small containers, particularly elongated containers of generally uniform section, this results in a more pleasing appearance, since the radial overhang of the cap relative to the container body may be reduced.

Another feature, with respect to elongated packages wherein the container including its neck has a generally uniform internal diameter, the overall outer diameter of the container and cap may be reduced, resulting in a savings in material for the fabrication of both the container and cap.

Another advantage of the package according to the invention, particularly for an elongated container having a generally uniform inner diameter, is that the overall length of the container may be reduced without reducing the interior capacity of the package; and correspondingly the overall length of the package may be reduced. That is for a selected interior depth capacity of the container, the length of the container may be reduced and, correspondingly, the overall length of the package.

In FIG. 6 the package is illustrated as enclosing a stack of tablets 25 (shown in phantom lines); and it will be seen that the stack may extend to the very top of the container flexible member 20. For a container of the type illustrated in FIG. 6, the tablets would only be stacked to a level just below the juncture of the neck 43 with the body 41. Tablets stacked above this level might well interfere with the seating of the cap flexible member 55 within the tapered seat 48, particularly with automatic closing apparatus. It will be apparent then that for a package of the type shown in FIG. 6, the length of the container and the overall length of the package would necessarily be substantially greater than those for a container and package of the type illustrated in FIG. 5.

While the preferred embodiment of the invention has been illustrated and described, it will be understood by those skilled in the art that changes and modifications may be resorted to without departing from the spirit and scope of the invention.

What is claimed is:

1. A fluid tight safety container and cap combination including: a container having a neck portion comprising a generally cylindrical annular wall; a cap having a base with a peripheral skirt projecting axially therefrom for receiving said neck; interengageable locking elements on the outer wall of said container neck and on the inner wall of said cap skirt; said container locking elements being spaced peripherally from each other; and said cap locking elements being engageable with and disengageable from said container locking elements through combined axial and rotative motion of said cap relative to said container; wherein the improvement comprises an annular, flexible member formed on the distal end of said neck, as an axial extension thereof, and having an outer annular free end disposed in a plane perpendicular to said neck and said flexible member; said annular flexible member having a stiffness to prevent axial deformation thereof;

said cap having means providing an annular sloping surface disposed between said base and said locking elements; said cap sloping surface being engageable with said free end of said flexible member, to deflect said flexible member radially and thereby to exert an axial biasing force between said cap and container when said locking elements are engaged.

2. A safety container and cap as set forth in claim 1 wherein the improvement comprises said container flexible member being generally cylindrical; and said cap sloping surface comprising a frustoconical surface reducing in diameter toward said cap base.

3. A safety container and cap as set forth in claim 1 wherein the improvement comprises the inner wall of said container flexible member comprising a continuation of the inner wall of said container neck.

4. A safety container and cap as set forth in claim 1 wherein the improvement comprises said annular free end of said container flexible member being deflected radially by said cap sloping surface, when said locking elements are engaged, to provide a continuous seal between said container and said cap.

5. A safety container and cap as set forth in claim 1 wherein the improvement comprises said annular free end of said flexible member being spaced axially a selected distance from said container lugs, and said cap sloping surface being spaced axially a corresponding selected distance from said cap lugs, that said annular free end is deflected radially by said sloping surface when said locking elements are engaged, thereby to maintain said axial biasing force and to maintain a gas and liquid impervious seal between said container and said cap.

6. A safety container and cap as set forth in claim 4 wherein the improvement comprises said flexible member comprising an imperforate extension of said neck.

7. A safety container and cap as set forth in claim 5 wherein the improvement comprises said flexible member comprising an imperforate extension of said neck.

* * * * *

UNITED STATES PATENT AND TRADEMARK OFFICE

CERTIFICATE OF CORRECTION

PATENT NO. : 4,223,795

DATED : September 23, 1980

INVENTOR(S) : Edward G. Akers

It is certified that error appears in the above—identified patent and that said Letters Patent is hereby corrected as shown below:

Column 4, line 16, "humitidy" snould read -- humidity --.

Column 4, line 43, delete "the" (first occurence); delete "inner end" and substitute -- container and --.

Signed and Sealed this

*Sixteenth* Day of *June 1981*

[SEAL]

*Attest:*

RENE D. TEGTMEYER

*Attesting Officer*

*Acting Commissioner of Patents and Trademarks*